United States Patent [19]

Blanding et al.

[11] Patent Number: 4,483,452

[45] Date of Patent: Nov. 20, 1984

[54] TELEVISION BULB

[75] Inventors: Wendell S. Blanding, Painted Post; Robert V. VanDewoestine, Corning, both of N.Y.

[73] Assignee: Corning Glass Works, Corning, N.Y.

[21] Appl. No.: 328,138

[22] Filed: Dec. 7, 1981

[51] Int. Cl.[3] ..... H01J 61/30

[52] U.S. Cl. ..... 220/2.1 A; 313/477 R

[58] Field of Search ..... 220/2.1 R, 2.1 A, 2.2; 65/138; 313/317, 318, 477 R–482; 250/549; 358/247

[56] References Cited

U.S. PATENT DOCUMENTS

| | | | |
|---|---|---|---|
| 2,324,972 | 7/1943 | Wright | 220/2.1 R X |
| 2,362,172 | 11/1944 | Swanson | 220/2.1 R X |
| 2,504,504 | 4/1950 | Despois | 313/482 |
| 2,618,759 | 11/1952 | Hoyt | 220/2.1 A X |
| 2,655,452 | 10/1953 | Barnes et al. | 358/247 |
| 2,761,990 | 9/1956 | Amdursky et al. . | |
| 2,767,342 | 10/1956 | Anthony . | |
| 2,785,821 | 3/1957 | Vermaas et al. . | |
| 2,825,129 | 3/1958 | Hempel . | |
| 2,889,952 | 6/1959 | Claypoole . | |
| 3,114,620 | 12/1963 | Giffen . | |
| 3,162,933 | 12/1964 | Trax et al. | 220/2.1 A X |
| 3,231,356 | 1/1966 | Giffen . | |
| 3,341,731 | 9/1967 | Wilson | 313/318 |
| 3,422,298 | 1/1969 | Gier . | |
| 3,582,306 | 6/1971 | Giffen . | |
| 3,673,049 | 6/1972 | Giffen et al. . | |
| 3,708,622 | 1/1973 | Brown et al. . | |
| 3,720,345 | 3/1973 | Logue | 220/2.1 A |
| 3,898,509 | 8/1975 | Brown, Jr. et al. | 220/2.1 A |
| 3,947,620 | 3/1976 | Plant et al. | 220/2.1 A X |
| 4,029,898 | 6/1977 | Belentepe et al. . | |
| 4,076,143 | 2/1978 | Jenne, Jr. et al. | 313/317 |
| 4,080,695 | 3/1978 | Gallaro et al. . | |
| 4,084,193 | 4/1978 | Palac . | |
| 4,214,886 | 7/1980 | Shay et al. . | |
| 4,238,043 | 12/1980 | Minami et al. | 220/2.1 R |
| 4,238,704 | 12/1980 | Bonk et al. | 220/2.1 A |
| 4,329,620 | 5/1982 | Lanciano | 358/247 |
| 4,342,942 | 8/1982 | Hockenbrock | 220/2.1 A X |

FOREIGN PATENT DOCUMENTS

| | | | |
|---|---|---|---|
| 639895 | 11/1963 | Belgium | 358/247 |
| 1304104 | 4/1962 | France | 358/247 |
| 666520 | 6/1950 | United Kingdom . | |
| 1005485 | 9/1965 | United Kingdom | 220/2.1 A |

*Primary Examiner*—Stephen Marcus
*Assistant Examiner*—Robert Petrik
*Attorney, Agent, or Firm*—B. R. Turner

[57] ABSTRACT

A television bulb is set forth which defines various structural relationships within the bulb construction to enable the manufacture of thin, lightweight TV tubes. The bulb is formed from strengthened glass systems such as laminated sheet glass or chemically strengthened glass, and includes a panel and a funnel having mating outwardly-extending peripheral flange portions which are sealed together. In addition to the peripheral flange portion, the panel includes a central viewing section and sloping sidewall portions which are all tangentially connected together.

57 Claims, 8 Drawing Figures

Fig. 7
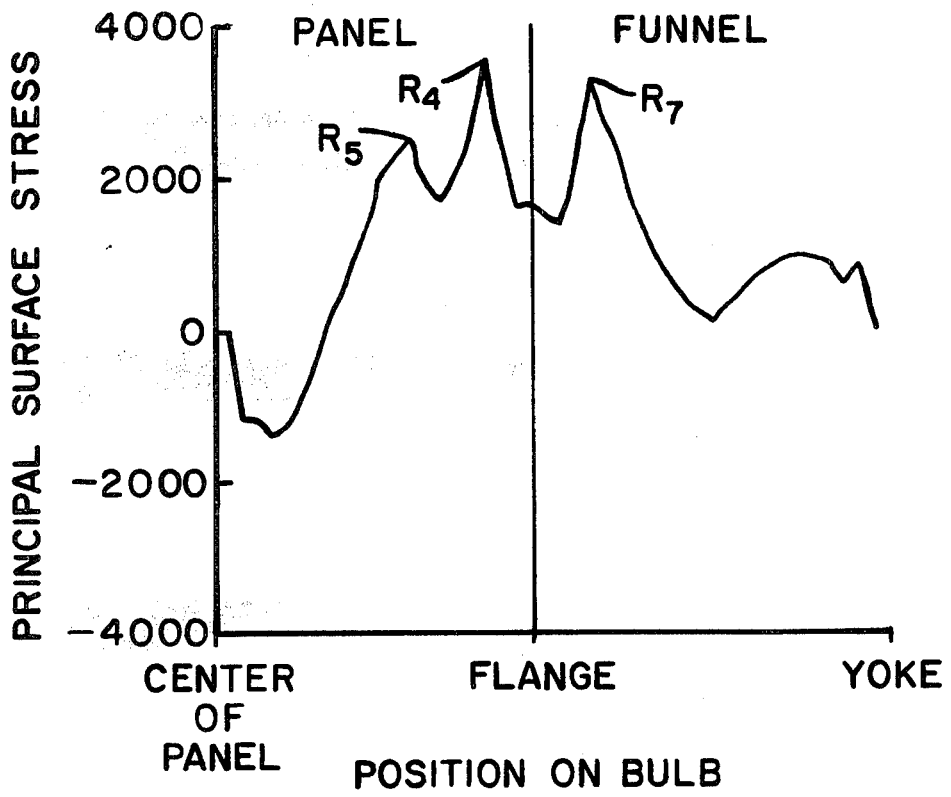
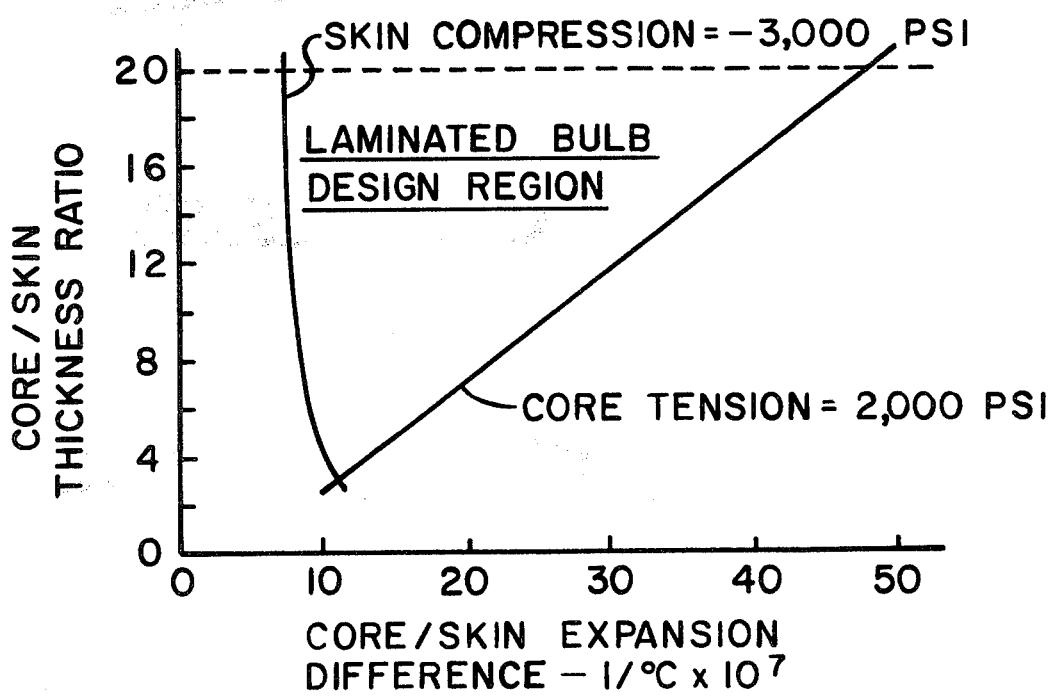
Fig. 8

TELEVISION BULB

BACKGROUND OF THE INVENTION

Color television bulbs are now traditionally produced with a glass panel and a glass funnel, which are frit-sealed together, and the bult is evacuated when it is converted into a TV tube. Accordingly, the outer surface of the bulb is subjected to substantial surface tensile stress which must be compensated for in its construction in order to avoid implosion and maintain the required safety and integrity of the finished tube. In fact, the resulting surface tensile stress formed on the panel of an evacuated tube has had a limiting effect as to the size of the viewing panel which can now be safely manufactured within practical thickness and weight constraints. That is, in order to compensate for such stresses, it became necessary to increase the thickness of the glass within the viewing panel, however practical weight and economic considerations have limited the size of the panel which could be safely incorporated in an evacuated color TV tube.

The conventional glass panel, such as shown in U.S. Pat. No. 4,080,695 has a skirt or axial flange portion surrounding the viewing portion of the panel, and the skirt portion has a sealing edge which abuts a sealing edge of the funnel to which it is frit-sealed. In view of the rather abrupt radius traditionally formed at the juncture between the skirt or axial flange and the viewing section of the panel, high tensile forces tend to be generated at such juncture, which are of course increased when the surface area of the viewing section is enlarged. Thus, in order to compensate for such stress, relatively thick, and accordingly heavy, glass panels were required.

A rather recent all-glass color TV bulb construction having a skirtless or axially flangeless faceplate is shown in U.S. Pat. No. 4,084,193. The construction of such all-glass bulb having a skirtless panel is similar in many respects to the construction of TV bulbs proposed in the early 1950's as shown in U.S. Pat. Nos. 2,767,342; 2,785,821; and 2,825,129, wherein a relatively flat skirtless glass panel was fused to a flanged rim portion of a metal funnel. Both the more recent all-glass bulb with a skirtless panel and the older bulb construction with a metal funnel and skirtless glass panel not only required relatively thick glass panels to compensate for the surface tensile stress induced in such relatively flat panels; but also required rather large rigid containment flanges about the outer edge portions of the skirtless panels to compressibly confine such panel edge portions when the tube was subjected to vacuum, and thereby produce less tension in the panel surface per se in order to satisfy safety requirements.

Another color television bulb construction which was disclosed in the 1950's is set forth in U.S. Pat. No. 2,761,990. The bulb is of an all-glass construction, but incorporates a panel member having a rearwardly converging frustoconical skirt portion which complements the frustoconical shape of the funnel. Both the funnel and the frustoconical skirt portion of the panel have radially-outwardly extending flange portions which are sealed together in the formation of a color TV tube. Upon evacuation of the tube, it appears that a bending moment would be induced at the juncture of the frustoconical skirt and viewing portions of the panel, resulting in undesirably high tensile forces at such acute angle juncture and/or at the sealing flange. Also, such structure would require relatively thick glass panel sections in order to withstand the induced stress.

Like the present invention, U.S. Pat. No. 3,114,620 relates to the manufacture of a TV bulb with the use of sheet glass. However, such patent is directed to the utilization of two one-part or unitary sheets of glass which are fusion sealed together while still in a semi-molten condition to form a black and white TV bulb. No consideration is given to the resulting stresses which would be formed within the faceplate of the bulb when the bulb is evacuated in the formation of a tube. The relatively flat panel portion of the tube when made with the disclosed unitary glass sheet would severely limit the size of the tube which could be manufactured within the necessary constraints.

Although safety panels have been laminated to the viewing panel in order to improve safety and reduce implosion, as shown by U.S. Pat. No. 3,708,622, the present invention combines the use of strengthened glass and specific structural geometries to provide an improved television bulb, which not only may be made of thinner glass and be of a lighter weight than conventional glass color TV bulbs, but also has less maximum surface tensile stress in the viewing panel when the bulb is made into a color TV tube. Preferably, the strengthened glass is in the form of laminated or composite glass sheet comprising a tensionally stressed core and a compressively stressed surface layer, such as set forth in U.S. Pat. No. 3,673,049.

SUMMARY OF THE INVENTION

The color television bulb of the present invention includes a panel or faceplate formed of strengthened glass and a funnel also formed of strengthened glass, which are sealed together with a devitrified frit in a conventional manner such as disclosed in U.S. Pat. No. 2,889,952. The glass may be chemically or thermally strengthened glass, but preferably is a strengthened laminated sheet glass comprising a core in tension with compressively stressed surface layers fused thereto. Accordingly, since the bulb assembly is made from strengthened glass, it is able to safely withstand surface tension much higher than that which is sustainable by conventional annealed glass.

In addition, the geometry of the panel is selected so as to provide greater strength, and less stress than would occur in a conventional TV panel of the same size and glass thickness. That is, the geometric configuration of the panel is selected so as to provide a sloping sidewall and a radial sealing flange, which effectively replace the relatively thick glass in the junctures or corner portions between the viewing panel and the skirt of conventional TV panels. The relatively wide radial flange, sealed to a mating flange on a funnel, has the effect of constraining the panel when a vacuum is applied and thus results in less panel deflection than if the flange were not present. Further, increasing the depth of the sloping sidewall portions, within practical limits, results in a stronger panel.

Thus, a principal object of the present invention has been to provide an improved all-glass television bulb construction which enables the production of relatively thin lightweight TV tubes while maintaining or improving their structural integrity and safety factors.

BRIEF DESCRIPTION OF THE DRAWINGS

FIG. 7 is a graph illustrating the principal surface stress on a TV bulb of the present invention.

FIG. 8 is a correlation of thickness and expansion relationships defining a laminated bulb design region.

DESCRIPTION OF THE PREFERRED EMBODIMENTS

Figure 1:
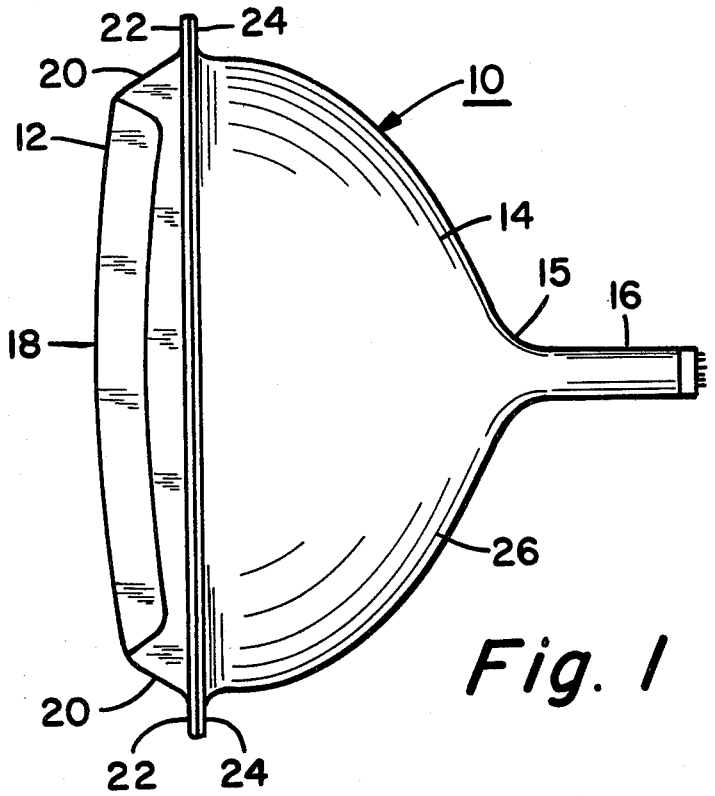
FIG. 1 is a side elevational view of a color television bulb of the present invention.
Figure 2:
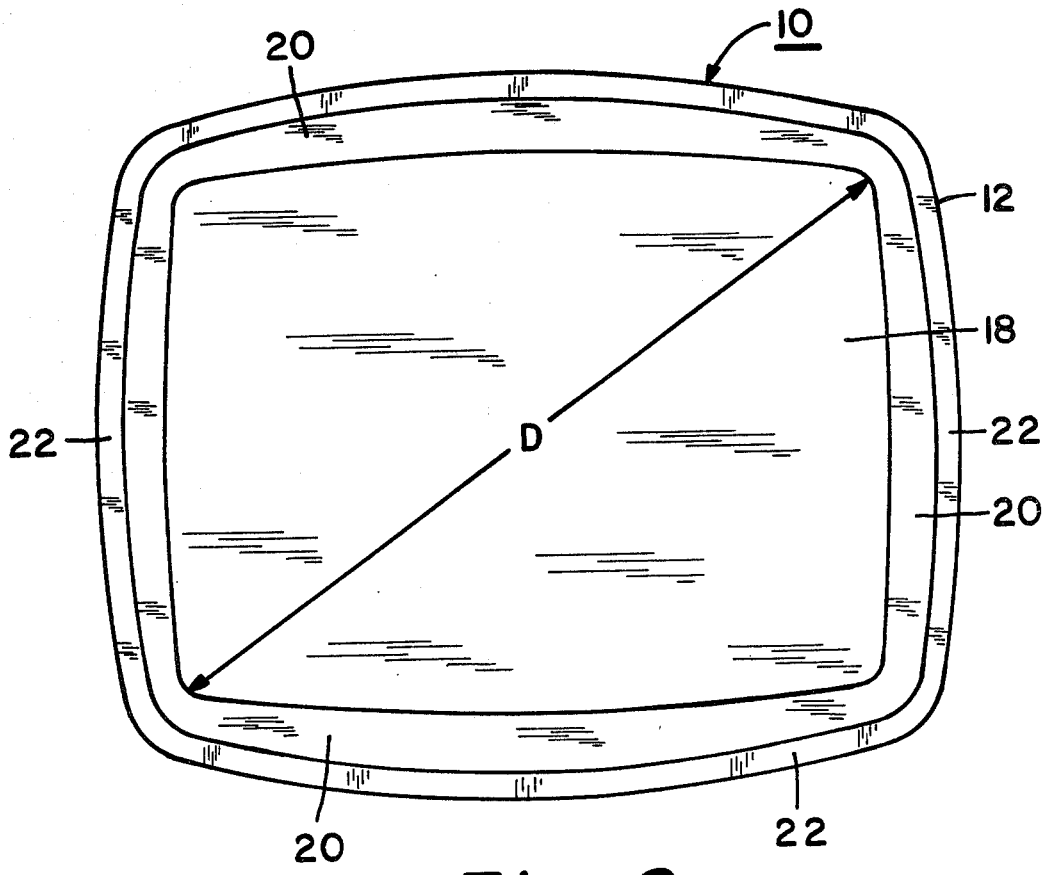
FIG. 2 is a front view of the bulb shown in FIG. 1.

As shown in the drawings, and particularly FIGS. 1 and 2, the configuration of the color television bulb of the present invention is significantly different from that of a conventional bulb such as shown in U.S. Pat. No. 4,080,695. That is, the conventional bulb is usually formed from a pressed panel and a pressed or spun funnel, with the panel having a relatively constant thickness on the front surface and a straight-sided skirt around the edge of the viewing surface. For a 25" bulb, the panel center thickness is about 0.48" and the maximum stress is generally about 1100 psi tension which occurs on the radius between the front face and the skirt or sidewall. However, as noted by the drawings, the color television bulb 10 of the present invention includes a faceplate or panel 12 and a funnel 14 which may have a neck assembly 16 secured thereto. The faceplate or panel 12 has a central viewing section 18 surrounded by tapered or outwardly sloping sidewall portions 20 which terminate in a radially-outwardly extending sealing flange 22 about the periphery of the panel. The panel 12 has inner and outer surfaces, with the inner surface extending about said sealing flange 22 and providing a sealing surface portion 23 (FIG. 3) circumferentially thereabout.

Figure 5:
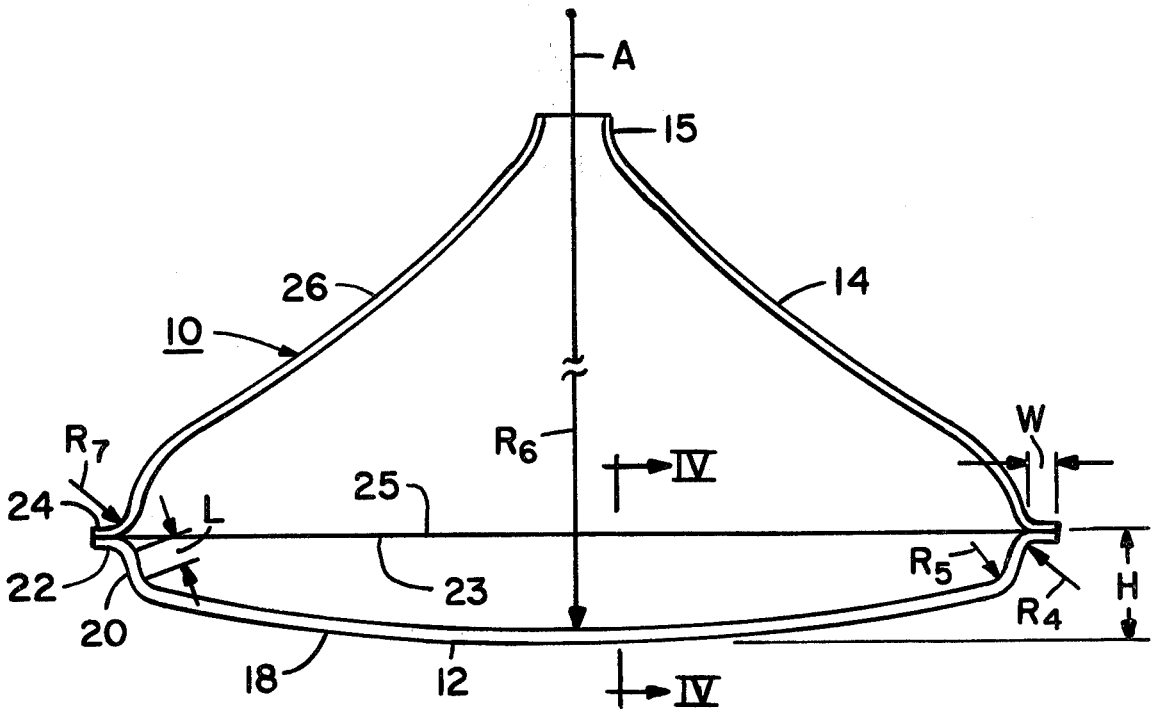
FIG. 5 is a schematic view of a further embodiment of a color television bulb.

The funnel 14, which is preferably made with rounded or spherical portions for increased strength, may be made in various shapes such as the bulbous convex shape shown in FIG. 1 or the flatter concave shape shown in FIG. 5. The funnel 14 is provided with an outwardly-extending sealing flange 24 having a circumferential sealing surface 25 (FIG. 3) about the periphery of its open mouth portion for cooperable sealing engagement with the flange 22 of panel 12. The flanges 22 and 24 are frit sealed together circumferentially about their complementary sealing surface portions. Although not shown in FIG. 3, as may be seen in the schematic illustration of FIG. 5, the uniform thickness of the viewing section of faceplate or panel 12 is approximately equal to the thickness of the flange portion 22 of the panel, whereas the flange portion 24 of the funnel 14 may have a thickness which is slightly less than flange 22, with the funnel tapering in thickness from the flanged seal area 24 toward the yoke area 15 to which the neck portion 16 is secured as shown in FIG. 1.

Various parameters may be utilized to specify the shape of the bulb of the present invention necessary to obtain the operational limits required to achieve a thin-walled lightweight structure while maintaining the maximum stress limits well within a safe operating range. The radii and distances which define the bulb structure are shown particularly in FIGS. 5 and 6. The plan view of the panel 12 and the open face of the funnel 14 are virtually identical, and are composed of a combination of three different arcs or radius means which are tangent at their intersections. The first arc, which is defined by radius $R_1$, is the radius of the pair of opposed peripheral edge portions along the major axis of the bulb; the second arc, as defined by the radius $R_2$, is the radius of the pair of opposed peripheral edge portions along the minor axis of the bulb; and the third arc, which is defined by radius $R_3$, is the radius of the two pairs of diagonally opposed peripheral curvilinear corners connecting the major and minor peripheries. The relative x, y positions of each radius is shown in parenthesis in FIG. 6. The tangency conditions between the various radii impose constraints which allow the calculation of radius $R_1$ and radius $R_2$ from the major and minor axis dimensions (a) and (b) of the bulb, along with the corner radius $R_3$ and its center. The radius $R_1$ for the periphery along the major axis of the bulb and a radius $R_2$ along the periphery of the minor axis of the bulb are set forth as follows:

$$R_1 = \frac{x_3^2 - R_3^2 - 2by_3 + y_3^2 + b^2}{2b - 2R_3 - 2y_3}$$

$$R_2 = \frac{y_3^2 - R_3^2 - 2x_3a + x_3^2 + a^2}{2a - 2R_3 - 2x_3}$$

The radii which determine the panel elevation sections, such as radius $R_4$ between the flange 22 and sidewall portions 20, radius $R_5$ between the sidewall portions 20 and the viewing section or screen area 18, and radius $R_6$ which is the radius of the viewing section, are also determined such that they are mutually tangential. In such case, the panel height H, radius $R_4$, radius $R_5$, and radius $R_6$ are given the desired values, and the length L and angle of the tapered sidewall portions 20 are calculated to give a closed curve. The length L of the connecting section of sidewall portions 20 may either be straight or a pair of radii. The screen or picture area 18 of the bulb 10 is defined by the area inside the locus of points defined by the tangency of radii $R_5$ and $R_6$ on the inside surface of the panel. Further, the diagonal dimension D (shown in FIG. 2) is the length of the viewing section or picture area 18 on the diagonal of the bulb, as taken across the inner surface of the panel. The width W of the flanges 22 and 24 is shown in FIG. 5 as extending between the outer periphery of the flange and the base of the sidewalls. The radius $R_6$ has a center along an axis A extending centrally of panel 12 and bulb 10, and perpendicular to a central portion of the viewing section 18. The height H of the panel 12 is defined by the maximum perpendicular distance between a pair of parallel planes which are perpendicular to said central axis A, wherein one of said parallel planes is tangential to a central portion of the outer surface of the panel 12 and the other of said parallel planes passes through a sealing surface portion 23 of the panel.

The funnel 14 has a complementary radially-outwardly extending flange 24 around the periphery of its open mouth portion and has a radius $R_7$ which blends the flange 24 into the curvature defining the body portion 26 of the funnel 14. As shown in FIG. 1, the body portion 26 may be of a bulbous convex configuration, or as shown in FIG. 5, it may be more of a tapered concave configuration. The funnel thickness is substantially constant across the flange area 24, and similar to the uniform thickness of the flange area 22 of the panel, and then decreases linearly between the flange 24 and the yoke 15 to a specified yoke thickness which may typically be about 0.1".

Various bulbs having the flanged panel and the yoke configuration of the present invention were subjected to typical evacuation conditions and the details of the stresses and deflections for various geometries were investigated. The stresses shown in FIG. 7 are typical of the principal surface stress exhibited in the various designs. As shown, the center of the panel contains moderate compressive stresses which become tensile stresses toward the flange. There is a peak stress where the viewing section 18 of the panel blends into the sidewall 20 at radius $R_5$, which is mostly due to bending. In addition, there is a second higher peak, also mostly from bending, where the radius $R_4$ blends the sidewall 20 into the flange 22. The stress at the seal is almost entirely hoop tension. The bending stresses again increase at radius $R_7$ where the flange 24 blends into the sidewall 26 of the funnel. Finally, the stresses decrease in the yoke and neck area down to a relatively low level.

The analysis of the various bulbs provided a basis for defining various relationships within the bulb geometries. That is, if the size of the bulb were reduced or expanded through a linear change in all bulb dimensions, the stresses within the bulb would be unchanged, however the deflections would decrease for smaller bulbs and increase for larger bulbs. The stresses exhibited in TV bulbs are a combination of membrane and bending stresses, and since the configuration of the panel is somewhere between spherical and linear, the relationship between panel thickness and stress may be defined as the inverse of the panel thickness somewhere between the first and second power. As the panel depth or sidewall portions 20 are increased, assuming constant panel thickness and diagonal dimension, the maximum stresses in the panel decrease. As radius $R_1$ and radius $R_2$ increase, the maximum bulb stresses increase slowly, whereas when radius $R_6$ and radius $R_7$ increase, the maximum stresses within the bulb increase rapidly.

Figure 3:
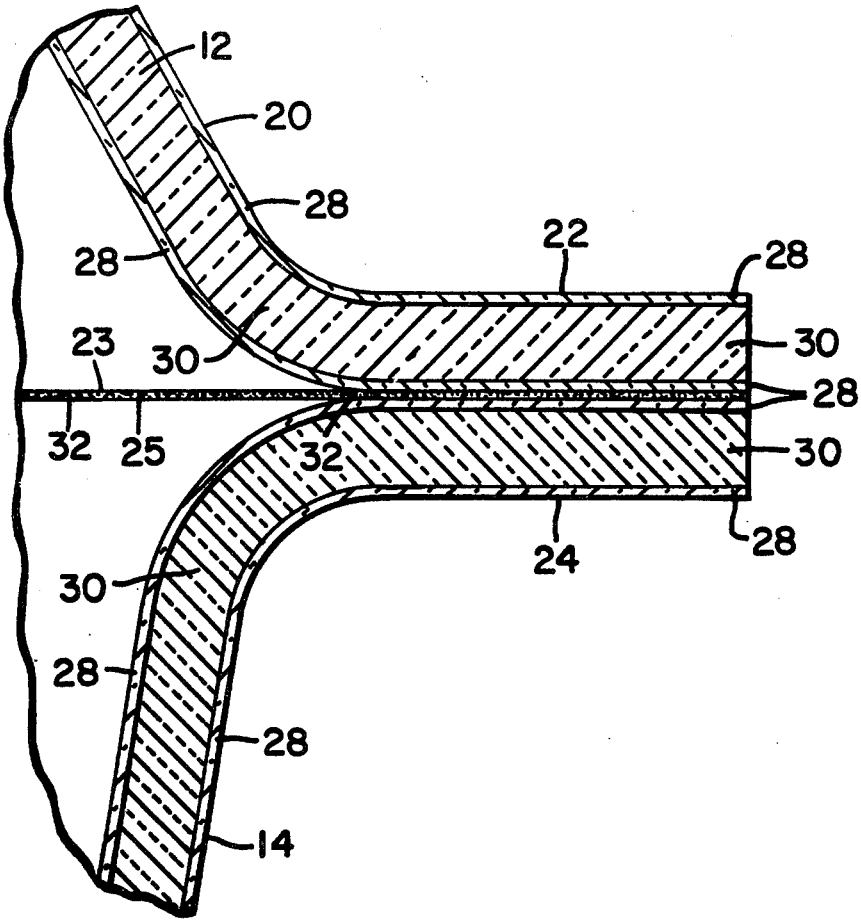
FIG. 3 is a greatly enlarged fragmental cross sectional view of a sealing flange portion of the bulb shown in FIG. 1.
Figure 4:
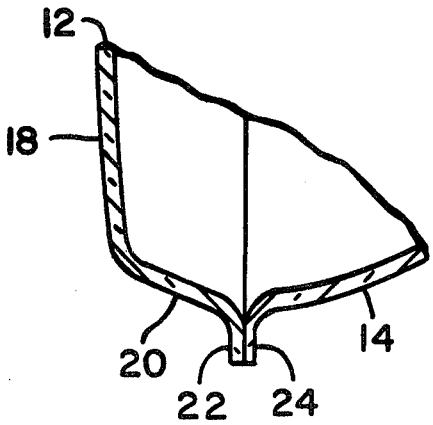
FIG. 4 is a cross sectional view taken along line IV—IV of FIG. 5.

Both the panel 12 and the funnel 14 are preferably formed from a 3-layer laminate sheet, with 2 skin layers of one-glass composition surrounding a core layer of a second composition, as shown more particularly in FIG. 3. The outer or skin layers 28 have a lower coefficient of thermal expansion than the inner core glass 30. The panel 12 and the funnel 14 are shown as being frit sealed together at 32 between sealing surface portions 23 and 25 of the flanges 22 and 24, respectively.

In order to achieve practical operative effectiveness in bulb construction, various parameters can be set forth defining the skin and the core relationship. For example, each layer of skin glass should be between about 0.002" and 0.02" thick in order to provide an abrasion resistance skin which does not become unduly thick. If the skin is less than about 0.002", it is not sufficiently durable mechanically to avoid detrimental abrasion, whereas if it is much above 0.02", the core tension increases beyond desired limits. In addition, the skin compression produced by the expansion mismatch between the skin and the core glass should be greater than 3000 psi, to give a meaningful difference over the 1100 psi obtainable with annealed glass, and the core tension produced by the expansion mismatch should be less than 2000 psi to avoid spontaneous breakage. Further, to be within practical thickness limitations so that the skin is not extremely thin or the core unduly thick, the ratio of core glass thickness to skin glass thickness should be less than 20 to 1. These conditions of skin compression and core tension within a core to skin thickness of less than 20 are represented graphically in FIG. 8. The following equations were used to define the limit lines in FIG. 8:

$$\text{Core tension} = \frac{E_1(\alpha_1 - \alpha_2)(T_0 - T)}{\left(1 + \frac{E_1}{E_2}\,\frac{t_1}{2t_2}\right)\left(\frac{1}{1-\nu}\right)}$$

$$\text{Skin compression} = E_1\frac{t_1}{2t_2}\,\frac{(\alpha_1 - \alpha_2)(T_0 - T)}{\left(1 + \frac{E_1}{E_2}\,\frac{t_1}{2t_2}\right)\left(\frac{1}{1-\nu}\right)}$$

Wherein:
1=core
2=skin
E=modulus of elasticity=$10\times10^6$ psi
$t_1$=core glass thickness
$t_2$=skin glass thickness (per side)
$\alpha$=coefficient of thermal expansion
$T_0$=strain point temperature=475° C.
T=ambient temperature=25° C.
$\nu$=Poisson's ratio for the glass.

Figure 6:
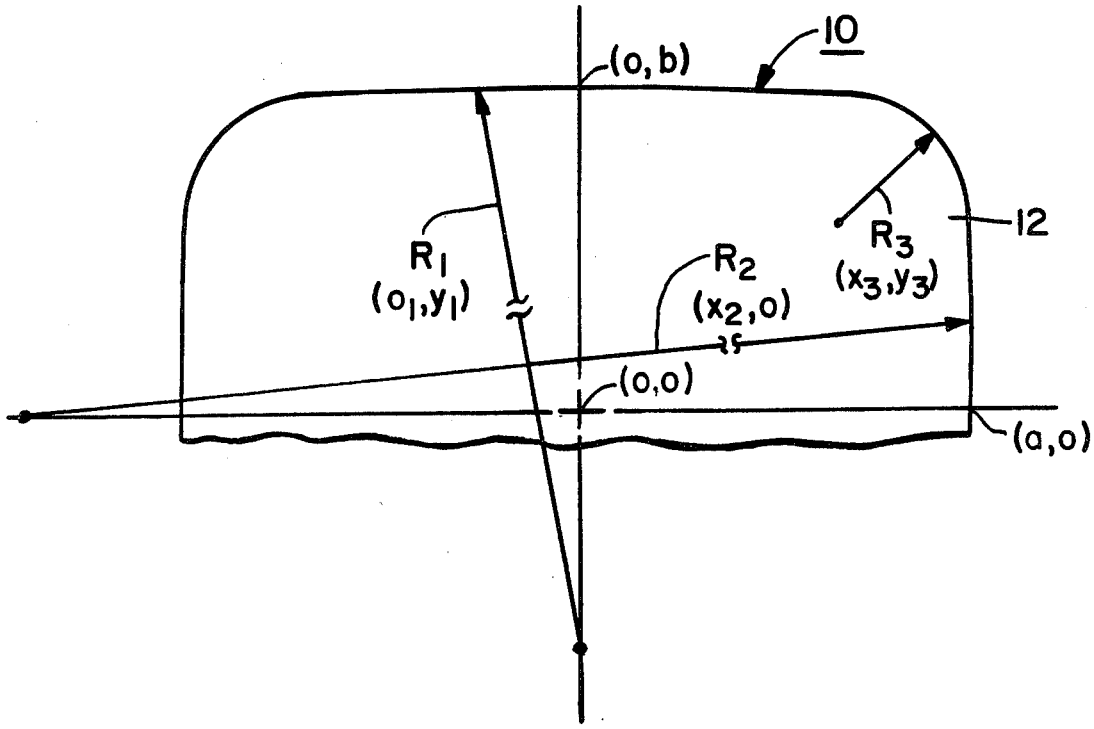
FIG. 6 is a fragmental schematic view of the front panel of the bulb shown in FIG. 5.

As pointed out earlier with respect to FIGS. 5 and 6, the panel is composed of a flange 22, a radius $R_4$, a radius $R_5$, a radius $R_6$, and a connecting section L which can be either a straight section or the intersecting radiuses of $R_4$ and $R_5$. The picture area 18 of the bulb 10 is defined as the area inside the locus of points defined by the tangency of radii $R_5$ and $R_6$ on the inside of the bulb. The diagonal dimension D (FIG. 1) is the length of the picture area on the diagonal of the bulb across the inside of the panel. Various parameters for defining the bulb geometry can be expressed with respect to their relationship to the diagonal D of the bulb. That is, the panel thickness should be between about 0.75% to 2% of the diagonal dimension. If the thickness is less than 0.75% of the diagonal, stresses within the bulb would be unduly high, resulting in a breakage. Should the thickness be greater than about 2% of the diagonal, one would be approaching the conventional bulb thickness, thus diminishing the advantage of the present invention. The width W of the flanges 22 and 24 should be between about 1.5% and 4% of the diagonal dimension. If below 1.5% of the diagonal, the flange would be too small to withstand the stresses generated within the bulb and breakage would occur, whereas if the flange is much above 4% of the diagonal dimension it would become unduly large and clumsy.

Radiuses $R_4$ and $R_5$ should be between 0.5% and 4% of the diagonal dimension. If such radiuses are less than the stated lower limits, they become extremely sharp and stress problems develop, whereas when above the upper stated limit, the radiuses do not fit the bulb, sizes must be increased and stress problems develop. The radius $R_6$ should be 1.5 to about 4 times the diagonal dimension. If less than about 1.5 times the diagonal dimension, the curvature of the viewing area becomes unduly sharp and projects outwardly from the sidewalls of the panel, whereas when the radius is greater than 4 times the diagonal, the viewing panel becomes extremely flat and stresses or thicknesses become excessive. If desired, the viewing area could be made cylindrical with the radius of the cylinder being within the designated criteria. The height H of the panel should be between about 6% and 20% of the diagonal dimension. If the height is too small, there is not sufficient room for the mask, and stresses tend to build up, whereas if the height is too large the size of the funnel must be reduced accordingly. The connecting section or sidewall portions 20 are of such a length L and angle so as to close the curve formed by the adjacent connecting curves $R_4$ and $R_5$, so that all such intersections are tangent.

The peripheral dimensions of the panel and the funnel are formed by three radii, radius $R_1$, radius $R_2$, and radius $R_3$. The radii are tangent at their intersecting points. Radius $R_1$ and radius $R_2$ should be about 1.2 to 2.5 times the diagonal dimension, whereas radius $R_3$ should be about 3% to 15% of the diagonal dimension. In a like manner, the outside dimensions of the open face portion of the funnel are the same as those of the panel, and the flange 24 on funnel 14 meets the same criteria as the flange 22 on panel 12. Similarly, radius $R_7$ should be about 0.5% to about 4% of the diagonal dimension, similar to radius $R_4$ on the panel. The funnel flange thickness is approximately equal to the panel thickness to keep the stresses similar in the flange area, however unlike the panel thickness which is substantially uniform across its extent, the thickness of the funnel decreases from the flange toward the yoke, with the minimum thickness where the neck seals to the yoke of about the 0.05".

The skin glass 28 on the panel should have a lead content of below 2% in order to prevent electron browning. The core glass, however, should have a high lead content in order to provide the necessary x-ray protection. Electron browning of the core glass is prevented by the skin glass which absorbs the electrons, and x-ray browning of both glasses may be inhibited by the conventional use of cerium oxide. Various combinations of skin and core glasses may be utilized to provide the desired degree of x-ray absorption while inhibiting x-ray browning, such as shown in U.S. Pat. No. 3,422,298, however the expansion coefficients must be modified in order to fall within the skin compression and core tension limits produced by expansion mismatch as set forth in FIG. 8.

As a specific example, a laminated bulb may be formed with a diagonal dimension of 30", a funnel flange thickness of 0.3" and a panel thickness of 0.3" with a flange width of 1". In addition, the specific example would have the following radiuses: $R_1=45"$; $R_2=45"$; $R_3=2.5"$; $R_4=0.5"$; $R_5=0.5"$; $R_6=45"$; and $R_7=0.5"$. The height H would equal 3.16". The panel thickness of 0.3" would include a core of 0.27" and a skin on each side of the core of 0.015", thus producing a core to skin thickness ratio of 9 to 1. With a $12.5\times10^{-7}/°C$. expansion difference between the skin and core glasses, a 5000 psi surface compression and a 550 psi core tension would be produced in the laminated body. When a test bulb was subjected to vacuum conditions, and strain gages were used to measure the changes in surface stresses produced by the application of the vacuum, it was found that a maximum change in surface tensile stress of about 3230 psi was measured on the surface of the test panel. Accordingly, the outside surface of the evacuated laminated bulb would be under 1770 psi compression (5000−3230=1770 psi), and the core tension is sufficiently low so that the glass would not break internally.

Laminated sheet glass may be formed either by an oriface delivery as shown in U.S. Pat. No. 3,582,306 or by an overflow laminated sheet forming process as shown in U.S. Pat. No. 4,214,886, and the panel or faceplate and the funnel may then be formed from such laminated sheet such as disclosed in U.S. Pat. No. 3,231,356. The panel and funnel could be formed directly from the hot glass as it eminates from the laminating system, or the laminated glass could be reformed in a reheating process as desired. One of the advantages of the present bulb assembly is that it enables one to make very thin, lightweight TV tubes. For example, a 30" diagonal TV bulb of the present invention would have a maximum thickness on the faceplate of about 0.3" and the bulb would weigh about 45 pounds, or about the same as a conventional 25" TV bulb. In the case of a 25" bulb made in accordance with the present invention, the faceplate thickness could be about 0.25" and the bulb would weigh approximately 27 pounds, or about 60% of the weight of a conventional 25" TV bulb.

The invention has been described with respect to various parameters, including radiuses $R_1$–$R_6$, which define the specific geometries making up the panel construction. In an endeavor to more clearly define the invention in the claims, however, it became apparent that the order in which the radiuses are set forth and described in the claims is not in the same numerical sequence used in the description of the drawings. In the claims, the first radius means refers to $R_6$, the second radius means refers to $R_5$, the third radius means refers to $R_4$, the fourth radius means refers to $R_1$, the fifth radius means refers to $R_2$, and the sixth radius means refers to $R_3$.

Although the now preferred embodiments of the present invention have been disclosed, various changes and modifications may be made thereto without departing from the spirit and scope thereof as defined in the appended claims.

We claim:

1. A panel for a television bulb comprising a central viewing section, sloping sidewall portions and peripheral flange means extending circumferentially about outer end portions of said sloping sidewall portions; first radius means ($R_6$) for forming said central viewing section having a center along an axis extending centrally of said panel and perpendicular to a central portion of said viewing section, second radius means ($R_5$) tangentially connecting with said central viewing section and said sloping sidewall portions, third radius means ($R_4$) tangentially connecting with said sloping sidewall portions and said peripheral flange means; said panel having an inner surface and an outer surface which extend along said central viewing section, said sloping sidewall portions and said peripheral flange means; said peripheral flange means having a circumferential sealing surface portion about the inner surface thereof, said viewing section of said panel being defined as the area inside the locus of points defined by the tangency of said first radius means ($R_6$) and said second radius means ($R_5$) on the inside surface of said panel, said viewing section having a diagonal dimension defined as the length of the viewing section taken on a diagonal across the inner surface of said panel, and said panel having a substantially uniform thickness across its extent of between about 0.75% and 2% of said diagonal dimension.

2. A panel for a television bulb as defined in claim 1 wherein said peripheral flange means has a width of between about 1.5% and 4% of said diagonal dimension.

3. A panel for a television bulb as defined in claim 1 wherein said first radius means has a radius which is between about 1.5 and 4 times said diagonal dimension.

4. A panel for a television bulb as defined in claim 1 wherein said second radius means has a radius which is between about 0.5% and 4% of said diagonal dimension.

5. A panel for a television bulb as defined in claim 1 wherein said third radius means has a radius which is between about 0.5% and 4% of said diagonal dimension.

6. A panel for a television bulb as defined in claim 1 wherein said panel comprises a laminate body having a central core glass bounded on opposite sides by opposed layers of outer skin glass, said core glass being of one composition, and said outer layers of skin glass being fused to said core glass and being of another composition having a lower coefficient of thermal expansion than that of said core glass.

7. A panel for a television bulb as defined in claim 6 wherein each layer of said skin glass is between about 0.002" and 0.02" thick.

8. A panel for a television bulb as defined in claim 6 wherein a compressive force is produced in the skin glass by the difference in the coefficients of thermal expansion between the core and skin glasses, and said skin compression is greater than 3000 psi.

9. A panel for a television bulb as defined in claim 6 wherein the ratio of core glass thickness to skin glass thickness is less than 20 to 1.

10. A panel for a television bulb as defined in claim 6 wherein a tensile force is produced in the core glass by the difference in the coefficients of thermal expansion between the core and skin glasses, and said core tension is less than 2000 psi.

11. A panel for a television bulb as defined in claim 6 wherein the ratio of the thickness of the core glass to the thickness of the skin glass is less than 20 to 1, the skin glass has a compressive force produced by the expansion mismatch between the core and skin glasses of greater than 3000 psi, and the core glass has a tensile force produced by the expansion mismatch between the core and skin glass of less than 2000 psi.

12. A panel for a television bulb as defined in claim 1 wherein said panel has a height measured along said central axis which is between about 6% and 20% of said diagonal dimension.

13. A panel for a television bulb as defined in claim 1 wherein the outer periphery of said panel when viewed in a plane perpendicular to said central axis comprises a first pair of opposed peripheral edge portions, a second pair of opposed peripheral edge portions and two pairs of diagonally opposed curvilinear corner portions connecting said first and second pairs of opposed peripheral edge portions, fourth radius means ($R_1$) forming said first pair of opposed peripheral edge portions, fifth radius means ($R_2$) forming said second pair of opposed peripheral edge portions, and sixth radius means ($R_3$) forming said two pairs of diagonally opposed curvilinear corner portions, said corner portions tangentially connecting with said first and second opposed peripheral edge portions, and said fourth radius means having a radius which is between about 1.2 and 2.5 times said diagonal dimension.

14. A panel for a television bulb as defined in claim 1 wherein the outer periphery of said panel when viewed in a plane perpendicular to said central axis comprises a first pair of opposed peripheral edge portions, a second pair of opposed peripheral edge portions and two pairs of diagonally opposed curvilinear corner portions connecting said first and second pairs of opposed peripheral edge portions, fourth radius means ($R_1$) forming said first pair of opposed peripheral edge portions, fifth radius means ($R_2$) forming said second pair of opposed peripheral edge portions, and sixth radius means ($R_3$) forming said two pairs of diagonally opposed curvilinear corner portions, said corner portions tangentially connecting with said first and second opposed peripheral edge portions, and said fifth radius means having a radius which is between about 1.2 and 2.5 times said diagonal dimension.

15. A panel for a television bulb as defined in claim 1 wherein the outer periphery of said panel when viewed in a plane perpendicular to said central axis comprises a first pair of opposed peripheral edge portions, a second pair of opposed peripheral edge portions and two pairs of diagonally opposed curvilinear corner portions connecting said first and second pairs of opposed peripheral edge portions, fourth radius means ($R_1$) forming said first pair of opposed peripheral edge portions, fifth radius means ($R_2$) forming said second pair of opposed peripheral edge portions, and sixth radius means ($R_3$) forming said two pairs of diagonally opposed curvilinear corner portions, said corner portions tangentially connecting with said first and second opposed peripheral edge portions, and said sixth radius means having a radius which is between about 3% and 15% of said diagonal dimension.

16. A panel for a television bulb comprising a central viewing section, outwardly sloping sidewall portions and a peripheral radially-outwardly extending sealing flange portion; first radius means ($R_6$) for forming said central viewing section having a center along an axis extending centrally of said panel and perpendicular to a central portion of said viewing section, second radius means ($R_5$) tangentially connecting with said central viewing section and said sloping sidewall portions, third radius means ($R_4$) tangentially connecting with said sloping sidewall portions and said sealing flange portion, said panel having an inner surface and an outer surface, the inner surface of said panel extending about said sealing flange portion and providing a sealing surface portion circumferentially about said flange portion, said panel having a height defined by the maximum perpendicular distance between a pair of parallel planes which are perpendicular to said central axis wherein one of said parallel planes is tangential to a central portion of the outer surface of said panel and the other of said parallel planes passes through a sealing surface portion of said panel, said viewing section of said panel being defined as the area inside the locus of points defined by the tangency of said first radius means ($R_6$) and said second radius means ($R_5$) on the inside surface of said panel, said viewing section having a diagonal dimension defined as the length of the viewing section taken on a diagonal across the inner surface of said panel, and the height of said panel being between about 6% and 20% of said diagonal dimension.

17. A panel for a television bulb as defined in claim 16 wherein said peripheral flange means has a width of between about 1.5% and 4% of said diagonal dimension.

18. A panel for a television bulb as defined in claim 16 wherein said first radius means has a radius which is between about 1.5 and 4 times said diagonal dimension.

19. A panel for a television bulb as defined in claim 16 wherein said second radius means has a radius which is between about 0.5% and 4% of said diagonal dimension.

20. A panel for a television bulb as defined in claim 16 wherein said third radius means has a radius which is between about 0.5% and 4% of said diagonal dimension.

21. A panel for a television bulb as defined in claim 16 wherein said panel comprises a laminate body having a central core glass bounded on opposite sides by opposed layers of outer skin glass, said core glass being of one composition, and said outer layers of skin glass being fused to said core glass and being of another composition having a lower coefficient of thermal expansion than that of said core glass.

22. A panel for a television bulb as defined in claim 21 wherein each layer of said skin glass is between about 0.002" and 0.02" thick.

23. A panel for a television bulb as defined in claim 21 wherein a compressive force is produced in the skin glass by the difference in the coefficients of thermal expansion between the core and skin glasses, and said skin compression is greater than 3000 psi.

24. A panel for a television bulb as defined in claim 21 wherein the ratio of core glass thickness to skin glass thickness is less than 20 to 1.

25. A panel for a television bulb as defined in claim 21 wherein a tensile force is produced in the core glass by the difference in the coefficients of thermal expansion between the core and skin glasses, and said core tension is less than 2000 psi.

26. A panel for a television bulb as defined in claim 21 wherein the ratio of the thickness of the core glass to the thickness of the skin glass is less than 20 to 1, the skin glass has a compressive force produced by the expansion mismatch between the core and skin glasses of greater than 3000 psi, and the core glass has a tensile force produced by the expansion mismatch between the core and skin glass of less than 2000 psi.

27. A panel for a television bulb as defined in claim 16 wherein said panel has a substantially uniform thickness across its extent of between about 0.75% and 2% of said diagonal dimension.

28. A panel for a television bulb as defined in claim 16 wherein the outer periphery of said panel when viewed in a plane perpendicular to said central axis comprises a first pair of opposed peripheral edge portions, a second pair of opposed peripheral edge portions and two pairs of diagonally opposed curvilinear corner portions connecting said first and second pairs of opposed peripheral edge portions, fourth radius means ($R_1$) forming said first pair of opposed peripheral edge portions, fifth radius means ($R_2$) forming said second pair of opposed peripheral edge portions, and sixth radius means ($R_3$) forming said two pairs of diagonally opposed curvilinear corner portions, said corner portions tangentially connecting with said first and second opposed peripheral edge portions, and said fourth radius means having a radius which is between 1.2 and 2.5 times said diagonal dimension.

29. A panel for a television bulb as defined in claim 16 wherein the outer periphery of said panel when viewed in a plane perpendicular to said central axis comprises a first pair of opposed peripheral edge portions, a second pair of opposed peripheral edge portions and two pairs of diagonally opposed curvilinear corner portions connecting said first and second pairs of opposed peripheral edge portions, fourth radius means ($R_1$) forming said first pair of opposed peripheral edge portions, fifth radius means ($R_2$) forming said second pair of opposed peripheral edge portions, and sixth radius means ($R_3$) forming said two pairs of diagonally opposed curvilinear corner portions, said corner portions tangentially connecting with said first and second opposed peripheral edge portions, and said fifth radius means having a radius which is between about 1.2 and 2.5 times said diagonal dimension.

30. A panel for a television bulb as defined in claim 16 wherein the outer periphery of said panel when viewed in a plane perpendicular to said central axis comprises a first pair of opposed peripheral edge portions, a second pair of opposed peripheral edge portions and two pairs of diagonally opposed curvilinear corner portions connecting said first and second pairs of opposed peripheral edge portions, fourth radius means ($R_1$) forming said first pair of opposed peripheral edge portions, fifth radius means ($R_2$) forming said second pair of opposed peripheral edge portions, and sixth radius means ($R_3$) forming said two pairs of diagonally opposed curvilinear corner portions, said corner portions tangentially connecting with said first and second opposed peripheral edge portions, and said sixth radius means having a radius which is between about 3% and 15% of said diagonal dimension.

31. A panel for a television bulb comprising a central viewing section, outwardly sloping sidewall portions and peripheral flange means extending circumferentially about outer end portions of said sloping sidewall portions; said panel comprising a laminate body having a central core glass fusion bounded on opposite sides by opposed layers of outer skin glass, said core glass being of one composition and said outer layers of skin glass being of another composition having a lower coefficient of thermal expansion than said core glass providing an expansion mismatch between said core and skin glasses, said skin glass having a compressive force produced by said expansion mismatch of greater than 3000 psi, said core glass having a tensile force produced by said expansion mismatch of less than 2000 psi, and the ratio of the thickness of the core glass to the thickness of the skin glass is less than 20 to 1.

32. A panel for a television bulb as defined in claim 31 wherein each layer of skin glass is between 0.002" and 0.02" thick.

33. A television bulb including a panel and a funnel, said panel and funnel having complementary outwardly extending peripheral sealing flange portions, means for sealing said outwardly-extending flange portions together, said panel having a curvilinear viewing section defined by a first radius ($R_6$) having an origin along a central axis which extends substantially perpendicular to and centrally of a plane substantially lying within a sealed juncture formed between said complementary peripheral sealing flange portions, sloping sidewall portions extending outwardly from said curvilinear viewing section and terminating at said outwardly-extending flange portion on said panel, second radius means ($R_5$) tangentially connecting said sloping sidewall portions with said viewing section, third radius means ($R_4$) tangentially connecting said outwardly sloping sidewall portions with said outwardly-extending flange portion on said panel; and said curvilinear viewing section, said sloping sidewall portions and said flange portion of said panel all being of a substantially uniform thickness, with said flange portion of said funnel having a maximum thickness equal to said substantially uniform thickness of said panel.

34. A television bulb including a panel and a funnel; said panel comprising a central viewing section, outwardly sloping sidewall portions and peripheral flange means extending circumferentially about outer end portions of said sloping sidewall portions; first radius means ($R_6$) for forming said central viewing section having a center along an axis extending centrally of said bulb and perpendicular to a central portion of said viewing section, second radius means ($R_5$) tangentially connecting with said central viewing section and said sloping sidewall portions, third radius means ($R_4$) tangentially connecting with said sloping sidewall portions and said peripheral flange means; said panel having an inner surface and an outer surface which extend along said central viewing section, said sloping sidewall portions and said peripheral flange means; said viewing section having a diagonal dimension defined as the length of the viewing section taken on a diagonal of the bulb, said peripheral flange means having a circumferential sealing surface portion about the inner surface thereof, said funnel having a yoke portion and an open mouth portion, complementary peripheral flange means extending circumferentially about said open mouth portion and having a circumferential sealing surface portion, means for sealing said panel and said funnel together about said circumferential sealing surface portions of their respective peripheral flange means, said panel having a substantially uniform thickness across its central viewing section, and said complementary peripheral flange means of said funnel having a thickness not exceeding said substantially uniform thickness of said panel.

35. A television bulb as defined in claim 34 wherein said viewing section of said panel is defined as the area inside the locus of points defined by the tangency of said first radius means and said second radius means on the inside surface of said panel, the diagonal dimension of said viewing section is taken on a diagonal across the inner surface of said panel, and the viewing section of said panel has a substantially uniform thickness across its extent of between about 0.75% and 2% of said diagonal dimension.

36. A television bulb as defined in claim 34 wherein the width of said peripheral flange means and said complementary peripheral flange means is between about 1.5% and 4% of said diagonal dimension.

37. A television bulb as defined in claim 34 wherein the height of said panel is between about 6% and 20% of said diagonal dimension.

38. A television bulb as defined in claim 34 wherein said first radius means has a radius which is between about 1.5 and 4 times said diagonal dimension.

39. A television bulb as defined in claim 34 wherein said second radius means has a radius which is between about 0.5% and 4% of said diagonal dimension.

40. A television bulb as defined in claim 34 wherein said third radius means has a radius which is between about 0.5% and 4% of said diagonal dimension.

41. A television bulb as defined in claim 34 wherein the outer periphery of said bulb when viewed in a plane perpendicular to said central axis comprises a first pair of opposed peripheral edge portions, a second pair of opposed peripheral edge portions and two pairs of diagonally opposed curvilinear corner portions connecting said first and second pairs of opposed peripheral edge portions, fourth radius means ($R_1$) forming said first pair of opposed peripheral edge portions, fifth radius means ($R_2$) forming said second pair of opposed peripheral edge portions, and sixth radius means ($R_3$) forming said two pairs of diagonally opposed curvilinear corner portions, said corner portions tangentially connecting with said first and second opposed peripheral edge portions, and said fourth radius means having a radius which is between about 1.2 and 2.5 times said diagonal.

42. A television bulb as defined in claim 34 wherein the outer periphery of said bulb when viewed in a plane perpendicular to said central axis comprises a first pair of opposed peripheral edge portions, a second pair of opposed peripheral edge portions and two pairs of diagonally opposed curvilinear corner portions connecting said first and second pairs of opposed peripheral edge portions, fourth radius means ($R_1$) forming said first pair of opposed peripheral edge portions, fifth radius means ($R_2$) forming said second pair of opposed peripheral edge portions, and sixth radius means ($R_3$) forming said two pairs of diagonally opposed curvilinear corner portions, said corner portions tangentially connecting with said first and second opposed peripheral edge portions, and said fifth radius means having a radius which is between about 1.2 and 2.5 times said diagonal dimension.

43. A television bulb as defined in claim 34 wherein the outer periphery of said bulb when viewed in a plane perpendicular to said central axis comprises a first pair of opposed peripheral edge portions, a second pair of opposed peripheral edge portions and two pairs of diagonally opposed curvilinear corner portions connecting said first and second pairs of opposed peripheral edge portions, fourth radius means ($R_1$) forming said first pair of opposed peripheral edge portions, fifth radius means ($R_2$) forming said second pair of opposed peripheral edge portions, and sixth radius means ($R_3$) forming said two pairs of diagonally opposed curvilinear corner portions, said corner portions tangentially connecting with said first and second opposed peripheral edge portions, and said sixth radius means having a radius which is between about 3% and 15% of said diagonal dimension.

44. A television bulb as defined in claim 34 wherein said panel and said funnel each comprise a laminate body having a central core glass bounded on opposite sides by opposed layers of outer skin glass, said core glass being of one composition, said outer layers of skin glass being fused to said core glass and being of another composition having a lower coefficient of thermal expansion than said core glass, and each layer of skin glass being between about 0.002" and 0.02" thick.

45. A television bulb as defined in claim 34 wherein said panel and said funnel each comprise a laminate body having a central core glass bounded on opposite sides by opposed layers of outer skin glass, said core glass being of one composition, said outer layers of skin glass being fused to said core glass and being of another composition having a lower coefficient of thermal expansion than said core glass, a compressive force being produced in the skin glass by the difference in the coefficients of thermal expansion between the core and skin glasses, and said skin compression being greater than 3000 psi.

46. A television bulb as defined in claim 34 wherein said panel and said funnel each comprise a laminate body having a central core glass bounded on opposite sides by opposed layers of outer skin glass, said core glass being of one composition, said outer layers of skin glass being fused to said core glass and being of another composition having a lower coefficient of thermal expansion than said core glass, and the ratio of core glass thickness to skin glass thickness being less than 20 to 1.

47. A television bulb as defined in claim 34 wherein said panel and said funnel each comprise a laminate body having a central core glass bounded on opposite sides by opposed layers of outer skin glass, said core glass being of one composition, said outer layers of skin glass being fused to said core glass and being of another composition having a lower coefficient of thermal expansion than said core glass, a tensile force being produced in the core glass by the difference in the coefficients of thermal expansion between the core and skin glasses, and said core tension being less than 2000 psi.

48. A television bulb as defined in claim 34 wherein said panel and said funnel each comprise a laminate body having a central core glass bounded on opposite sides by opposed layers of outer skin glass, said core glass being of one composition, said outer layers of skin glass being fused to said core glass and being of another composition having a lower coefficient of thermal expansion than said core glass, the ratio of the thickness of the core glass to the thickness of the skin glass being less than 20 to 1, the skin glass having a compressive force produced by the expansion mismatch between the core and skin glasses of greater than 3000 psi, and the core glass having a tensile force produced by the expansion mismatch between the core and skin glass of less than 2000 psi.

49. A color television bulb including a panel member and a funnel member; said panel member comprising a central viewing section, outwardly sloping sidewall portions and a peripheral sealing flange portion extending radially-outwardly from said sloping sidewall portions; first radius means ($R_6$) for forming said central viewing section haing a center along an axis extending centrally of said bulb and perpendicular to a central portion of said viewing section, second radius means ($R_5$) tangentially connecting with said central viewing section and said sloping sidewall portions, third radius means ($R_4$) tangentially connecting with said sloping sidewall portions and said sealing flange portion, said panel member having a continuous inner surface and a continuous outer surface, the inner surface of said panel member extending about said sealing flange portion and providing a sealing surface portion circumferentially about said flange portion, said panel member having a height defined by the maximum perpendicular distance between a pair of parallel planes which are perpendicular to said central axis wherein one of said parallel planes is tangential to a central portion of the outer surface of said panel member and the other of said parallel planes passes through a sealing surface portion of said panel member, said viewing section of said panel member being defined as the area inside the locus of points defined by the tangency of said first radius means ($R_6$) and said second radius means ($R_5$) on the inside surface of said panel member, said viewing section having a diagonal dimension defined as the length of the viewing section taken on a diagonal across the inner surface of said panel member, and the height of said panel member being between about 6% and 20% of said diagonal dimension.

50. A television bulb as defined in claim 49 wherein said funnel member has a complementary peripheral radially-outwardly extending sealing flange portion provided with a sealing surface portion circumferentially thereabout, means for sealing said funnel member and panel member together about said sealing surface portions of said sealing flange portions, and said sealing flange portions of said panel and said funnel having a width between about 1.5% and 4% of said diagonal dimension.

51. A television bulb including a panel and a funnel; said panel comprising a central viewing section, sloping sidewall portions and peripheral flange means extending circumferentially about outer end portions of said sloping sidewall portions; said funnel comprising a body portion having a yoke portion at one end and complementary peripheral flange means extending circumferentially about an opposite end, means for sealing said peripheral flange means and said complementary peripheral flange means together, said panel and said funnel each comprising a laminate body having a central core glass bounded on opposite sides by opposed layers of outer skin glass, each body having a core glass of one composition and outer layers of skin glass of another composition, said outer layers of skin glass having a lower coefficient of thermal expansion than said core glass producing an expansion mismatch between said core and skin glasses, said skin glass having a compressive force produced by said expansion mismatch of greater than 3000 psi, said core glass having a tensile force produced by said expansion mismatch of less than 2000 psi, and the ratio of thickness of the core glass to the thickness of the skin glass is less than 20 to 1.

52. A television bulb as defined in claim 51 wherein each layer of skin glass is between about 0.002" and 0.02" thick.

53. A television bulb as defined in claim 51 wherein said viewing section has a diagonal dimension defined as the length of the viewing section taken on a diagonal of the bulb, and said panel has a uniform thickness of between about 0.75% and 2% of said diagonal dimension.

54. A television bulb as defined in claim 51 wherein said viewing section has a diagonal dimension defined as the length of the viewing section taken on a diagonal of the bulb, and said peripheral flange means and said complementary peripheral flange means each having a width which is between about 1.5% and 4% of said diagonal dimension.

55. A television bulb as defined in claim 51 wherein said panel has a height defined by the maximum perpendicular distance between a pair of parallel planes which are perpendicular to a central axis passing through said bulb wherein one of said parallel planes is tangential to a central portion of an outer surface of said panel and the other of said parallel planes passes through said peripheral flange means on said panel, said viewing section has a diagonal dimension defined as the length of the viewing section taken along a diagonal of the bulb, and said height of said panel being between about 6% and 20% of said diagonal dimension.

56. A television bulb as defined in claim 51 wherein radius means tangentially connect said peripheral flange means with said sloping sidewall portions and second radius means tangentially connect said sloping sidewall portions with said central viewing section.

57. A television bulb as defined in claim 51 wherein said peripheral flange means and said complementary peripheral flange means are of substantially the same uniform thickness.

* * * * *